United States Patent [19]

Deutsch

[11] Patent Number: 4,608,903

[45] Date of Patent: Sep. 2, 1986

[54] SINGLE SIDE-BAND HARMONIC EXTENSION IN A POLYPHONIC TONE SYNTHESIZER

[75] Inventor: Ralph Deutsch, Sherman Oaks, Calif.

[73] Assignee: Kawai Musical Instrument Mfg. Co., Ltd., Hamamatsu, Japan

[21] Appl. No.: 652,039

[22] Filed: Sep. 19, 1984

[51] Int. Cl.[4] ..... G10H 1/06; G10H 7/00

[52] U.S. Cl. ..... 84/1.01; 84/1.19; 84/1.22; 84/1.24

[58] Field of Search ..... 84/1.01, 1.19–1.24

[56] References Cited

U.S. PATENT DOCUMENTS

| | | | |
|---|---|---|---|
| 3,000,252 | 9/1961 | Wayne, Jr. | 84/1.01 |
| 3,004,460 | 10/1961 | Wayne, Jr. | 84/1.01 |
| 4,223,583 | 9/1980 | Deutsch | 84/1.01 |
| 4,231,276 | 11/1980 | Ando et al. | 84/1.19 |
| 4,286,491 | 9/1981 | Deutsch | 84/1.01 |
| 4,301,704 | 11/1981 | Nagai et al. | 84/1.22 |
| 4,393,743 | 7/1983 | Wachi | 84/1.23 |
| 4,422,362 | 12/1983 | Chibana | 84/1.19 |
| 4,446,769 | 5/1984 | Deutsch | 84/1.01 |
| 4,453,441 | 6/1984 | Deutsch | 84/1.22 |

*Primary Examiner*—Stanley J. Witkowski

*Attorney, Agent, or Firm*—Ralph Deutsch

[57] ABSTRACT

A keyboard operated musical instrument is disclosed in which a musical tone having an extended range of harmonics is produced by combining two waveshapes at different fundamental frequencies. The first waveshape has a fundamental frequency corresponding to an actuated keyboard switch and has a spectrum containing a maximum of Q harmonics. The second waveshape is created by a single side-band modulation of two orthogonal musical signals each having a maximum of Q harmonics and has a phase coherence with the first waveshape. The second waveshape is generated at a frequency which is Q+1 greater than the fundamental frequency of the first waveshape. The first and second waveshapes are combined to produce a musical tone which has an extended range of harmonics.

17 Claims, 5 Drawing Figures

SINGLE SIDE-BAND HARMONIC EXTENSION IN A POLYPHONIC TONE SYNTHESIZER

BACKGROUND OF THE INVENTION

1. Field of the Invention

This invention relates to electronic musical tone synthesis and in particular is concerned with tones having an extended number of harmonics.

2. Description of the Prior Art

A relatively large number of harmonics are required for an electronic tone synthesizer which imitates certain types of musical sounds. These sounds include the brass, string, and reed families of tone. While the maximum harmonic capability of tone generation for almost any musical tone generator usually can be extended by adding to the number and size of the system elements, such a straightforward harmonic capability extension may not be economically feasible for a low cost musical instrument design. Increasing the maximum number of harmonics in a digital tone generation system may easily encounter a speed limitation imposed by the maximum clock speed at which the digital logic circuitry can be operated.

In U.S. Pat. No. 3,809,790 entitled "Implementation Of Combined Footage Stops In A Computor Organ" a method is disclosed for producing an approximation to a combination of tones at different fundamental frequencies during a single tone calculation algorithm which computes waveshape amplitudes by evaluating a discrete Fourier transform of a stored set of harmonic coefficients. The first tone is computed by using an incomplete set of harmonics and a second tone, at lower pitch, is computed by using the first harmonic and some low order odd numbered harmonics.

The present invention provides a novel implementation for extending the maximum harmonic capability of a digital musical tone generator.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted into musical waveshapes. A sequence of computation cycles is implemented during each of which three master data sets are generated. A master data set comprises a set of data points which define a period of a musical waveshape.

The first master data set is computed using a set of Q stored harmonic coefficients. The second and third master data sets are computed using a second set of Q stored harmonics coefficients. The third master data set is generated to be orthogonal to the second master data set. After the master data sets are computed, a transfer cycle is initiated during which the first master data set is transferred to a plurality of note registers, the second master data set is transferred to a plurality of even note registers, and the third master data set is transferred to a plurality of odd note registers. There is a note register, an even note register, and an odd note register associated with each tone generator.

The data stored in each of the three note registers associated with a common tone generator are read out sequentially and repetitively at a common memory advance rate corresponding to a fixed multiple of the fundamental musical frequency associated with an actuated keyboard switch to which the tone generator has been assigned.

The data read out from the even and odd note registers are combined by a single side-band modulator to produce a musical tone having a fundamental frequency which is Q+1 times greater than the fundamental frequency of the musical waveshape produced by reading out data from the note register. The two waveshapes are combined to produce a single musical waveshape having an extended range of harmonics.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a polyphonic musical tone generation system wherein musical waveshapes having an extended number of harmonics are created by a combination process using single-side modulation. The extended harmonic tone generation system is incorporated into a musical instrument of the type which synthesizes musical waveshapes by implementing a discrete Fourier transform algorithm. A tone generation system of this category is described in detail in U.S. Pat. No. 4,085,644 entitled "Polyphonic Tone Synthesizer." This patent is hereby incorporated by reference. In the following description all elements of the system which are described in the referenced patent are identified by two digit numbers which correspond to the same numbered elements appearing in the referenced patent.

Figure 1:
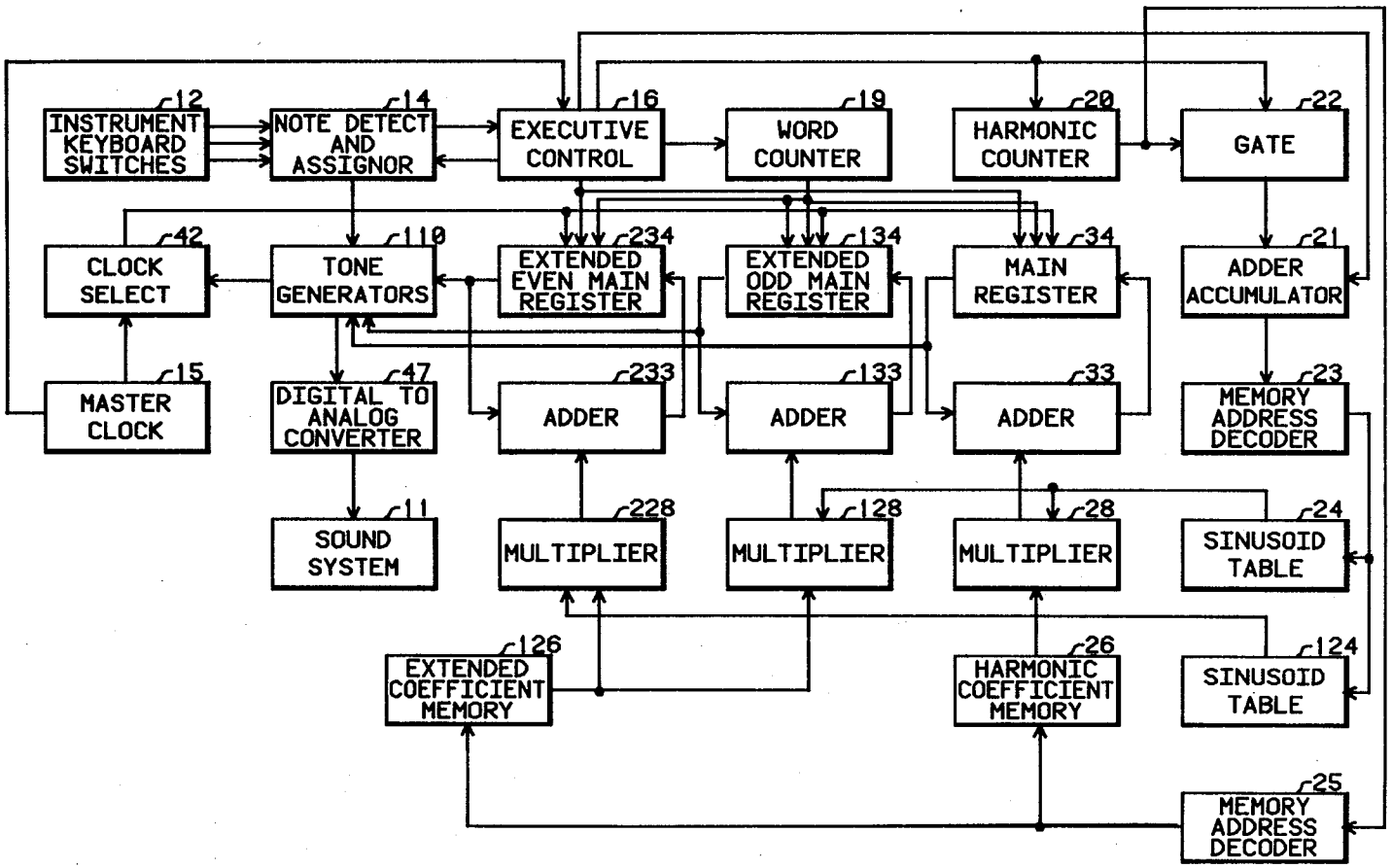
FIG. 1 is a schematic diagram of an embodiment of the invention.

FIG. 1 shows an embodiment of the present invention which is described as a modification and adjunct to the system described in the referenced patent U.S. Pat. No. 4,085,644.

As described in the referenced patent, the Polyphonic Tone Synthesizer includes an array of instrument keyboard switches 12. If one or more of the keyboard switches has a switch status change and is actuated ("on" switch position), the note detect and assignor 14 encodes the detected keyboard switch having the status change to an actuated state and stores the corresponding note information for the actuated keyswitches. A tone generator, contained in the block labeled tone generators 110, is assigned to each actuated keyswitch using information generated by the note detect and assignor 14.

A suitable configuration for a note detect and assignor subsystem is described in U.S. Pat. No. 4,022,098. This patent is hereby incorporated by reference.

When one or more keyswitches have been actuated, the executive control 16 initiates a repetitive sequence of computation cycles. During each computation cycle, three master data sets are computed. Each master data set contains 64 data words which are combined in a manner described below to create a musical waveshape having a maximum of 64 harmonics. In the system described in U.S. Pat. No. 4,085,644 the single master data set also has 64 data points which directly correspond to the amplitudes of 64 equally spaced points of one cycle of a waveform for a musical tone. However as described in the referenced patent, the maximum number of harmonics in the audio tone spectra is no more than 32 or one-half of the number of points in the single master data set.

As described in the referenced U.S. Pat. No. 4,085,644 it is desirable to be able to continuously recompute and store the master data sets during a repetitive sequence of computation cycles and to load this data into note registers while the actuated keyswitches remain actuated, or depressed, on the keyboards. There are three note registers associated with each tone generator contained in the system block labeled tone generators 110.

As described in the referenced U.S. Pat. No. 4,085,644 the harmonic counter 20 is initialized to its minimal, or zero, count state at the start of each computation cycle. Each time that the word counter 19 is incremented by the executive control 16 so that it returns to its minimal, or zero, count state because of its modulo counting implementation, a signal is generated by the executive control 16 which increments the count state of the harmonic counter 20. The word counter 19 is implemented to count modulo 64 which is the number of data words comprising each of the three master data sets.

At the start of each computation cycle, the accumulator in the adder-accumulator 21 is initialized to a zero value by the executive control 16. Each time that the word is incremented the adder-accumulator 21 adds the current count state of the harmonic counter 20 to the sum contained in the accumulator. This addition is implemented to be modulo 64.

The content of the accumulator in the adder-accumulator 21 is used by the memory address decoder 23 to access trigonometric values from the sinusoid table 24 and the sinusoid table 124. The sinusoid table 24 is advantageously implemented as a read only memory storing values of the trigonmetric function sin $(2\pi\phi/64)$ for $0 \leqq \phi \leqq 64$ at intervals of D. The sinuoid table 124 is advantageously implemented as a read only memory storing values of the trigonometric function cos $(2\pi\phi/64)$ for $0 \leqq \phi \leqq 64$ at intervals of D. D is a table resolution constant. The term sinusoid is used in the mathematical generic sense to denote both the trigonometric sine functions and the trigonometric cosine functions.

The memory address decoder 25 is used to simultaneously read out harmonic coefficients stored in the harmonic coefficient memory 26 and the extended coefficient memory 126 in response to the count state of the harmonic counter 20. The harmonic coefficient memory 26 stores 32 harmonic coefficients which correspond to the first 32 harmonics of the generated musical tone. The extended coefficient memory 126 stores 32 harmonic coefficients which correspond to the harmonics 33,34, . . . , 64 of the generated musical tone.

The multiplier 28 generates the product value of the trigonometric data value read out from the sinusoid table 24 and the value of the harmonic coefficient read out from the harmonic coefficient memory 26. The generated product value formed by the multiplier 28 is furnished as one input to the adder 33.

The contents of the main register 34, the extended odd main register 134, and the extended even main register 234 are initialized to a zero value by the executive control 16 at the start of each computation cycle. Each time that the word counter 19 is incremented, the content of the main register 34, at an address corresponding to the count state of the word counter 19, is read out and furnished as an input to the adder 33. The sum of the inputs to the adder 33 are stored in the main register at a memory location equal, or corresponding, to the count state of the word counter 19. After the word counter 19 has been cycled for 32 l complete cycles of 64 counts, the main register 34 will contain the first master data set.

The multiplier 128 generates the product value of the trigonometric data value read out from the sinusoid table 24 and the value of the harmonic coefficient read out from the extended coefficient memory 126. The generated product value formed by the multiplier 128 is furnished as one input to the adder 133.

Each time that the word counter 19 is incremented, the content of the extended odd main register 134, at an address corresponding to the count state of the word counter 19, is read out and furnished as an input to the adder 133. The sum of the inputs to the adder 133 are stored in the extended odd main register 134 at a memory location equal, or corresponding, to the count state of the word counter 19. After the word counter 19 has been cycled for 32 complete cycles of 64 counts, the extended odd main register 134 will contain the second master data set.

The multiplier 228 generates the product value of the trigonometric data value read out from the sinusoid table 124 and the value of the harmonic coefficient read out from the extended coefficient memory 126. The generated product value formed by the multiplier 228 is furnished as one input to the adder 233.

Each time that the word counter 19 is incremented, the content of the extended even main register 234, at an address corresponding to the count state of the word counter 19, is read out and furnished as an input to the adder 233. The sum of the inputs to the adder 233 are stored in the extended even main register 234 at a memory location equal, or corresponding, to the count state of the word counter 19. After the word counter 19 has been cycled for 32 complete cycles of 64 counts, the extended even main register 234 will contain the third master data set.

Figure 2:
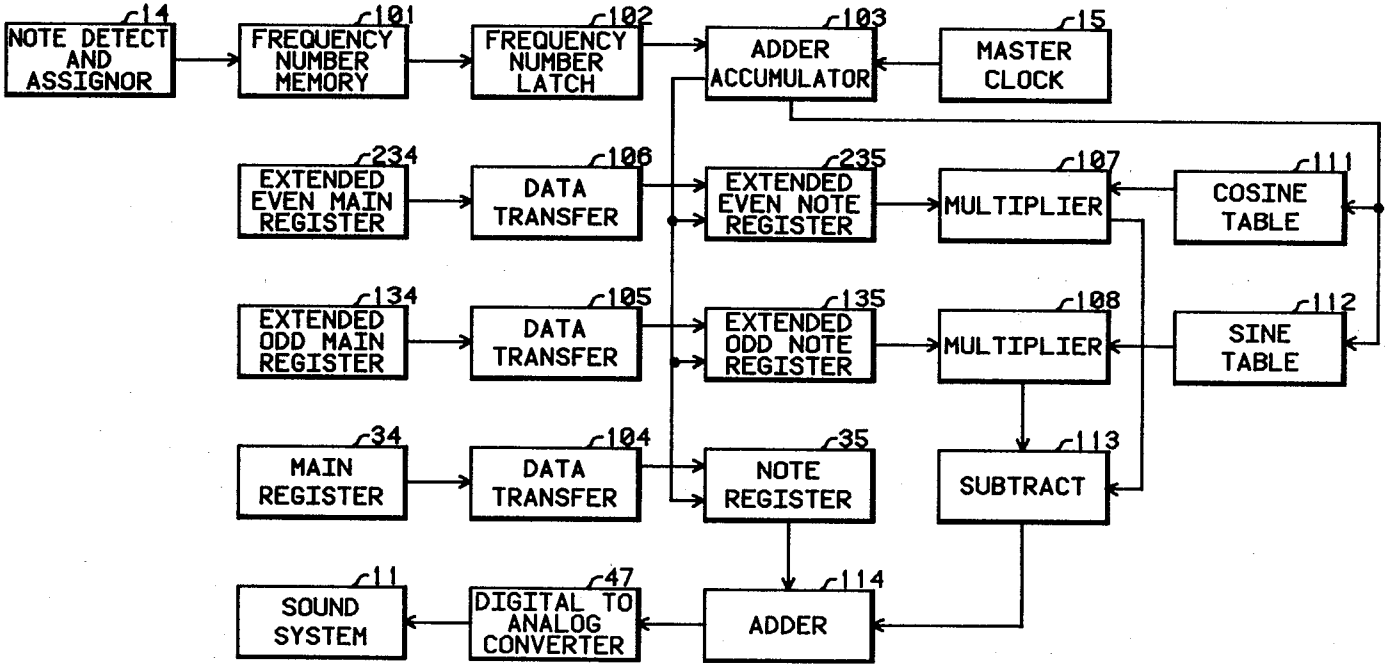
FIG. 2 is a schematic diagram of a tone generator.

FIG. 2 illustrates the details of one of the tone generators, contained in the system block labeled tone generators 110, which employs the three master data sets to produce a musical tone having an extended range comprising 64 harmonics. While only one tone generator is shown explicitly in FIG. 2 it is tacitly assumed that a similar arrangement is embodied in each of the tone generators contained in the system logic block labeled tone generators 110 in FIG. 1.

Following each computation cycle, in the repetitive sequence of computation cycles, a transfer cycle is initiated and executed. During a transfer cycle the first master data set is copied from the main register 34 and transferred to the note register 35, the second master data set is copied from the extended odd main register 134 and transferred to the extended odd note register 135, and the third master data set is copied from the extended even main register 234 and transferred to the extended even note register 235.

When the note detect and assignor 14 detects that a keyboard switch has been actuated, a corresponding frequency number is read out from the frequency number memory 101. The frequency number memory 101 can be implemented as a read-only addressable memory (ROM) containing data words stored in binary numeric format having values $2^{-(M-N)/12}$ where N has the range of values N=1,2, . . . , M and M is equal to the number of keyswitches on the musical instrument's keyboard. The frequency numbers represent ratios of frequencies of a generated musical tone with respect to the frequency of the master clock 15. A detailed description of the frequency numbers is contained in U.S. Pat. No. 4,114,496 entitled "Note Frequency Generator For A Polyphonic Tone Synthesizer." This patent is hereby incorporated by reference.

The frequency number read out of the frequency number memory 101 is stored in a frequency number latch 102. In response to timing signals provided by the master clock 15, the frequency number stored in the frequency number latch 102 is repetitively added to the content of an accumulator contained in the adder-accumulator 103. The six most significant bits of the accumulator content in the adder-accumulator are used to sequentially and repetitively read out data points stored in the note register 35, the extended odd note register 135, and the extended even note register 235.

Sine table 112 is an addressable memory containing the same trigonometric sine function values that are stored in the sinusoid table 24. Cosine table 111 is an addressable memory containing the same trigonometric cosine function values that are stored in the sinusoid table 124. The five most significant bits that are less than the six most significant bits in the content of the accumulator contained in the adder-accumulator 103 are used to address out trigonometric functions values from both the cosine table 111 and the sine table 112. In this fashion the memory advance rate at which trigonometric values are read from the cosine and sine table is 32 times faster than the memory advance rate at which the three master data sets are read out from the three note registers 35, 135, and 235.

The multiplier 107 performs a signal modulation function by multiplying the data values read out from the cosine table 111 by the data values of the third master data set which are read out of the extended even note register 235.

The multiplier 108 performs a signal modulation function by multiplying the data values read out from the sine table 112 by the data values read out of the second master data set which are read out of the extended odd note register 135.

The modulation terms produced by the multiplier 107 and 108 are subtracted from each other by means of the subtract 113. It is shown below that the output from the subtract 113 corresponds to a single-side band signal having 32 harmonics which has its lowest component frequency corresponding to the 33rd harmonic of the musical waveshape signal produced by reading out the first master data set stored in the note register 35.

The data values read out from the note register 35 is added by means of the adder 114 to the data values provided by the subtract 113. The net result is a musical waveshape that has a spectrum containing a maximum of 64 harmonics and there are no missing harmonics if all the harmonic coefficients stored in the harmonic coefficient memory 26 and the extended harmonic coefficient memory have non-zero values.

The operation of the system to produce an extended set of harmonics by using a single-side modulation can be demonstrated by the following set of mathematical relations. As described in the referenced patent U.S. Pat. No. 4,085,644 the points in the first master data set are computed according to the relation $$z_n = \sum_{q=1}^{32} c_q \sin 2\pi nq/64 \qquad \text{Eq. 1}$$

for the range of data points n=1,2, . . . , 64 and the range of harmonics q=1,2, . . . , 32. $c_q$ represents the harmonic coefficient for the harmonic q. These are the numbers that are stored in the harmonic coefficient memory 26. As computed by the relation in Eq. 1, the data set $z_n$ will have an odd symmetry about the midpoint value.

The second master data, since it is also computed using the trigonometric sine values read out of the sinusoid table, will also have a form analogous to Eq. 1. Thus the points values of the second master data set are computed according to the relation $$A_n = \sum_{q=1}^{32} d_q \sin 2\pi nq/64 \qquad \text{Eq. 2}$$

The harmonic coefficients $d_q$ are stored in the extended coefficient memory 126. The second master data set also has an odd symmetry about the midpoint value.

The third master data set is computed with the trigonometric cosine values stored in the sinusoid table 124. Therefore the point values of the third master data set are computed according to the relation $$B_n = \sum_{q=1}^{32} d_q \cos 2\pi nq/64 \qquad \text{Eq. 3}$$

The third master data has an even symmetry about the midpoint value.

The function of the multiplier 108 is to multiply the data values of the second master data set read out of the extended off note register 135 by the trigonometric sine values read out of the sine table 112. These sine values can be written as the sequence of point values $$U_n = F \sin 2\pi n32/64 \qquad \text{Eq. 4}$$

F is a scale factor. Notice that $U_n$ is a modulation function which is 32 times higher in frequency than the fundamental frequency of any of the master data sets.

The output data points produced by the multiplier 108 are the product of Eq. 2 and Eq. 4. The result of this multiplication is $$A_{nm} = A_n U_n \qquad \text{Eq. 5}$$

$$= F \sum_{q=1}^{32} d_q \sin(2\pi nq/64) \sin(2\pi n32/64)$$

Apply the trigonometric identity $$\sin[(x+y)/2] \sin[(x-y)/2] = (\cos y - \cos x)/2 \qquad \text{Eq. 6}$$

to Eq. 4 with the variables defined as $$x = 2\pi(nq+32)/64 \qquad \text{Eq. 7}$$

$$y = 2\pi(nq-32)/64$$

The net result of these substitutions is $$A_{nm} = F \sum_{q=1}^{32} d_q/2[\cos 2\pi(nq - 32)/64 - \cos 2\pi(nq + 32)/64] \quad \text{Eq. 8}$$

The first term in the square brackets represents the lower side band components produced by the modulation operation and the second term represents the supper side band components.

It is the upper side band components that are desired to produce the extended 32 harmonics to be added to those produced from the first master data set. To eliminate the lower side band components the additional modulation produced by the multiplier 107 is performed.

The function of the multiplier 107 is to multiply the data values of the third master data set read out of the extended even note register 235 by the trigonometric cosine values read out of the cosine table 111. These cosine values can be written as the sequence of point values $$V_n = F \cos 2\pi n32/64 \quad \text{Eq. 9}$$

It is noted that the modulation function $V_n$ is orthogonal to the modulation function $U_n$ which was applied to the second master data set.

The output data points produced by the multiplier 107 are the product of Eq. 3 and Eq. 9. The result of this multiplication is $$B_{nm} = F \sum_{q=1}^{32} d_q \cos(2\pi nq/64) \cos(2\pi n32/64) \quad \text{Eq. 10}$$

Apply the trigonometric identity $$\cos[(x+y)/2] \cos[(x-y)/2] = (\cos y + \cos x)/2 \quad \text{Eq. 11}$$

with the variables defined in Eq. 7 to Eq. 10. The result of these substitutions is $$B_{nm} = F \sum_{q=1}^{32} d_q/2[\cos 2\pi(nq - 32)/64 + \cos 2\pi(nq + 32)/64] \quad \text{Eq. 12}$$

The first term in the square brackets represents the lower side band components produced by the modulation operation and the second term represents the upper side band components.

The function of the subtract 113 is to form the difference $B_{nm} - A_{nm}$. Using Eq. 8 and Eq. 12 it is found that $$P_{nm} = B_{nm} - A_{nm} = F \sum_{q=1}^{32} d_q \cos 2\pi(nq + 32)/64 \quad \text{Eq. 13}$$

It is noted that the subtract 113 produces $P_{nm}$ which is the desired upper single side-band modulation terms. $P_{nm}$ represents a waveshape having harmonics $d_q$ at frequencies corresponding to the harmonic numbers 33 to 64 of the waveshape produced from the first master data set computed according to Eq. 1. The musical tone formed from the sequence of waveshape points $P_{nm}$ will have a fundamental frequency which is 32+1 times the fundamental frequency of the musical tone formed from the sequence of waveshape points read out from the note register 35.

An examination of Eq. 1,2 and 3 shows that the 32nd harmonic contribution is missing from the form of the discrete Fourier transform when it is expressed in its usual symmetric form having only sine or only cosine trigonometric terms. This missing maximum harmonic component is not a special characteristic property of the inventive system but is a natural result of computing the master data sets in the listed symmetric forms defined by Eqs. 1-3. A method of obtaining the complete set of 32 harmonics components is to store the trigonometric sine values sin $[2\pi(2\phi-1)/128]$ for values of $\phi=1,2,\ldots,64$ in the sinusoid table 24 instead of the sine values sin $[2\pi\phi/64]$. These are called fractional point trigonometric function values. Similarly the sinusoid table 124 stores the trigonometric cosine values cos $[2\pi(2\phi-1/128]$. A similar set of practical point trigonometric values can be stored in the sine table 112 and the cosine table 111.

It is remarked that the method of eliminating the undesirable lower side band modulation product terms relies upon two modulation operations of signals that are orthogonal to each other and upon the use of mutually orthogonal modulation functions. Since the second master data set is computed with the odd symmetric trigonometric sine values and the third master data set is computed with the even symmetric trigonometric cosine values, the second master data set is orthogonal to the third master data set.

For an extensive class of tones having an extended harmonic development, a simplified embodiment of the present invention will suffice. It is known that subjectively the distinctive tonal features of a musical tone are primarily determined by the relative strengths of the first few harmonics. Harmonics beyond about the 12th harmonic contribute primarily to produce a "fuzzy-like" background to the tone. Varying the relative strengths of the harmonics in the harmonic range of 33 to 64 harmonics does not appreciably affect the perceived aural characteristic of a musical tone.

A typical tone having an extended harmonic range is the type of tone classified by the generic tone family called "string" tone. Frequently an electronic musical instrument creates a string tone by generating a sawtooth waveform. It is known that the relative strength of harmonics for a sawtooth wave shape has the following form in which the relative harmonic strength is expressed in db $$db(q) = 20 \times \log_{10}(1/q) \quad \text{Eq. 14}$$

For the harmonic number q=33,db(33)=−30.37 while for the maximum harmonic number q=64,db(64)=−36.12. Thus the harmonic strength is relatively constant for the harmonics q=33 to q=64. The average value is −33 db.

Figure 3:
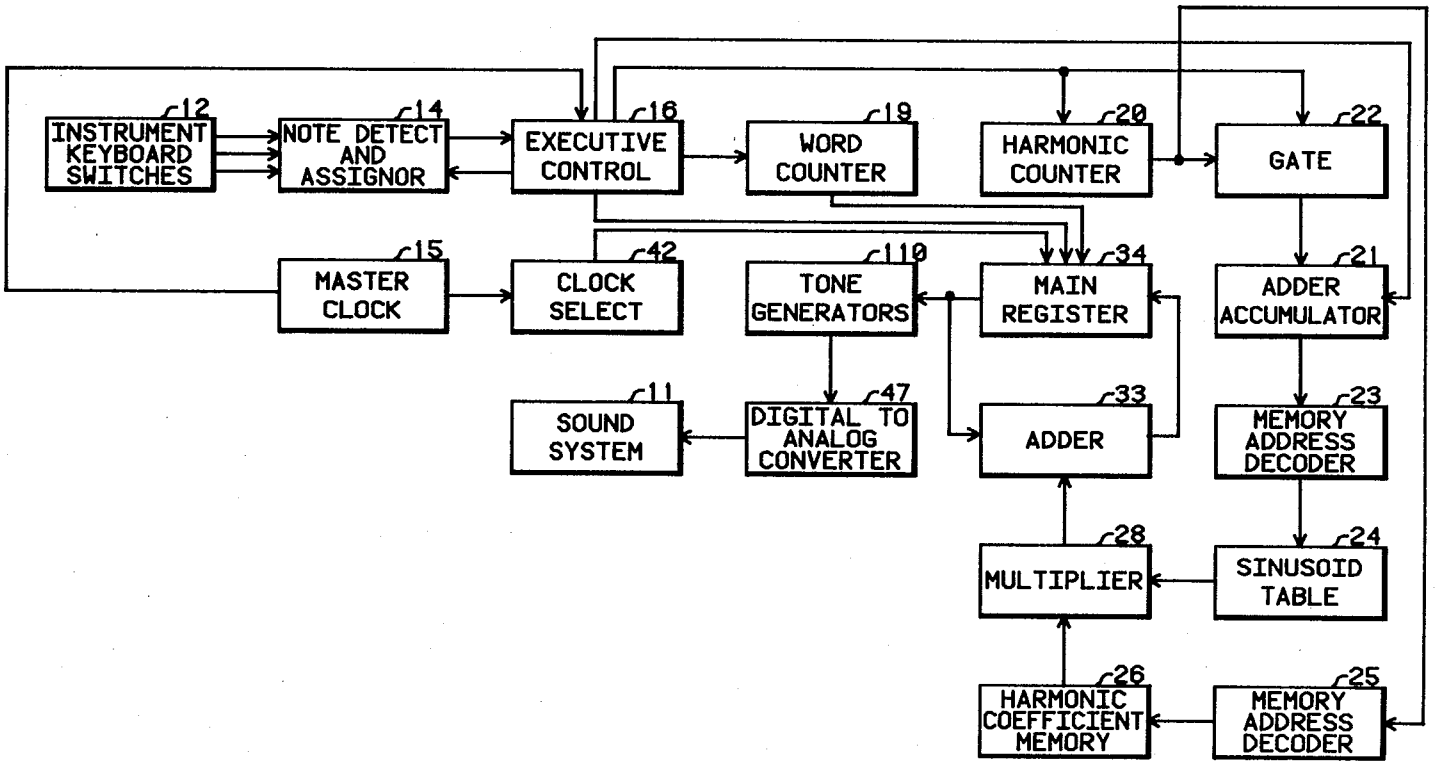
FIG. 3 is a schematic diagram of an alternate embodiment of the invention.

FIG. 3 shows an alternate embodiment of the invention in which the single side band harmonic waveshape harmonic extension has a fixed predetermined strength and only one master data set is computed during each one of the sequence of computation cycles.

The single master data is computed in the manner previously described for the computation of the first master data for the system embodiment shown in FIG. 1. At the end of a computation, the master data set is stored in the main register 34.

Figure 4:
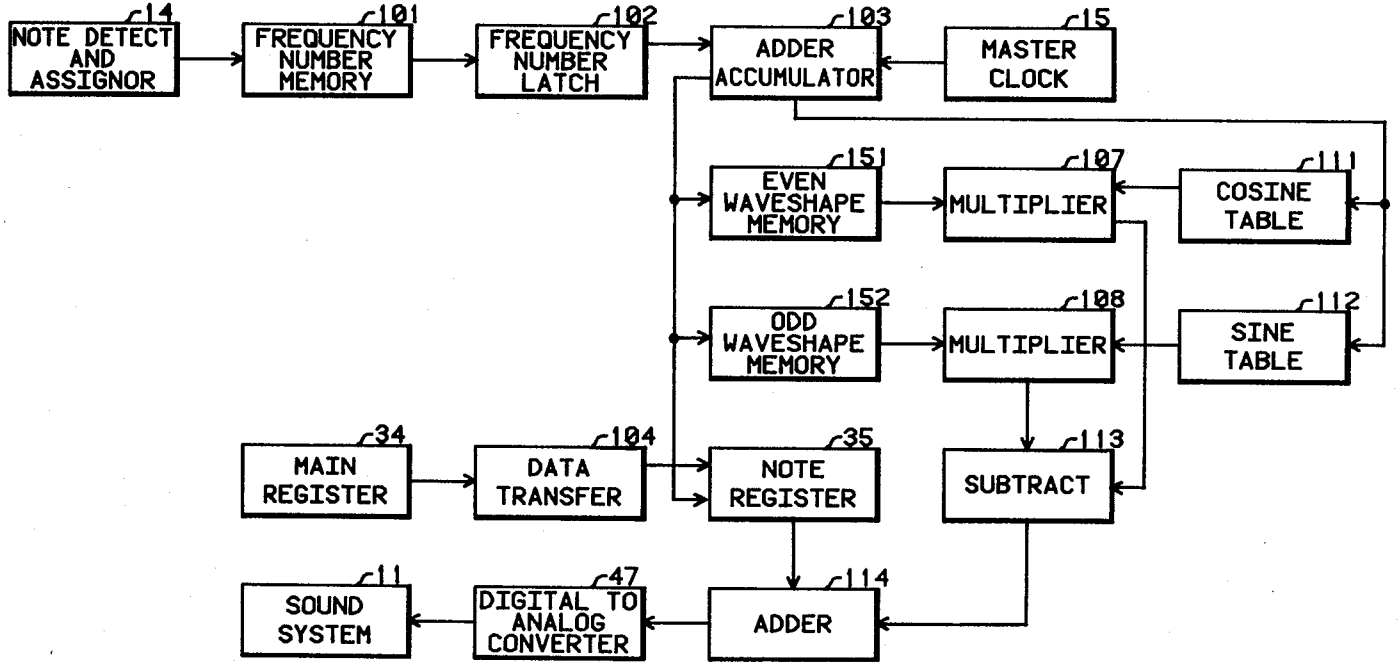
FIG. 4 is a schematic diagram of an alternate version of a tone generator.

The detailed logic for a tone generator is shown in FIG. 4. During a transfer cycle, the master data set is copied from the main register 34 and written into the note register 35. The even waveshape memory 151 is a read-only addressable memory storing 64 data values corresponding to equally spaced points for a waveshape having an even symmetry about the midpoint of the data set. This waveshape is precomputed to have all harmonics equal to each other and scaled in amplitude to −33 db with respect to the maximum value of the fundamental component of the waveshape determined by the master data set which was created during a computation cycle. The odd waveshape memory 152 is a read-only addressable memory storing 64 data values corresponding to equally spaced points for a waveshape having an odd symmetry about the midpoint of the data set. This waveshape is also precomputed to have all harmonics equal to each other and scaled in amplitude to −33 db with respect to the maximum value of the fundamental component of the waveshape determined by the master data set which was created during a computation cycle; in addition this waveshape is precomputed so that it is orthogonal to the waveshape corresponding to the data values stored in the even waveshape memory 151.

The remainder of the system blocks shown in FIG. 4 operate in the manner already described for the system arrangement shown in FIG. 2. The tone generation system is not limited to the use of stored waveshapes in the even waveshape memory 152 and the odd waveshape memory having equal harmonics. Any other type of precalculated waveshape points can be used. The main restriction is that the waveshape stored in the even waveshape memory 151 have an even symmetry and that it is orthogonal to the waveshape stored in the odd waveshape memory 152 which should have an odd symmetry.

Figure 5:
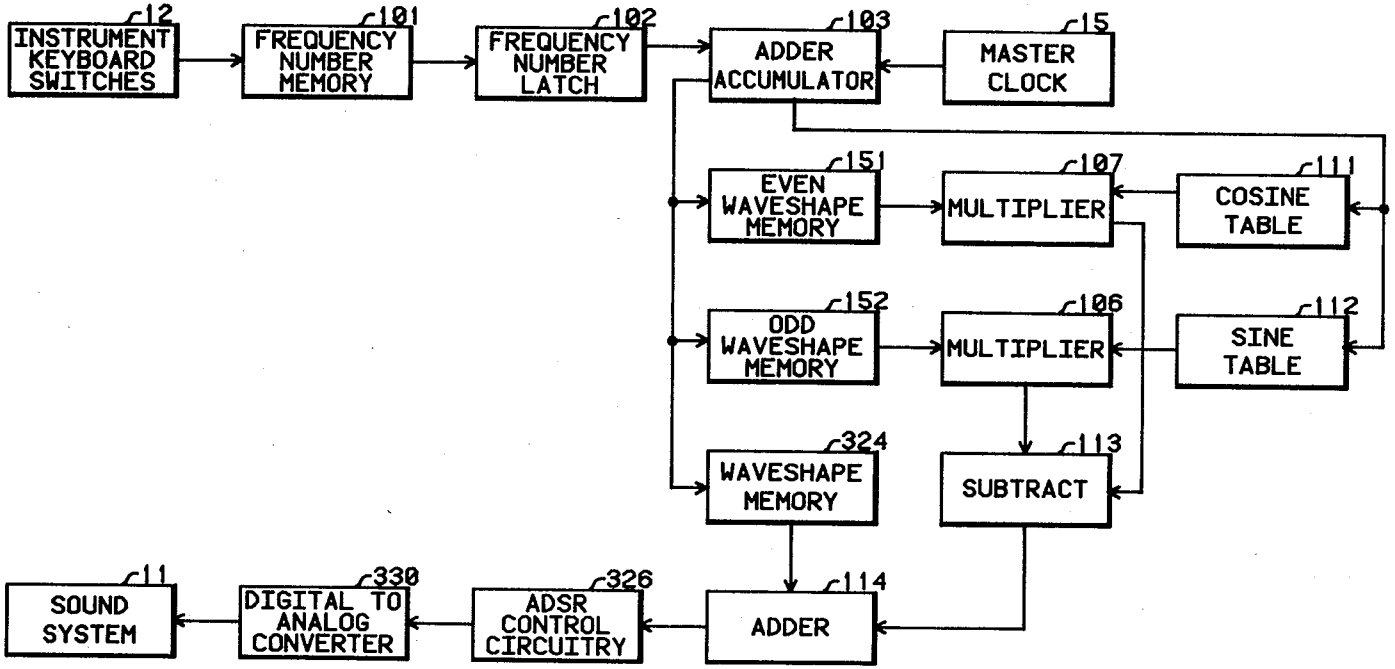
FIG. 5 is a schematic diagram of a second embodiment of the invention.

The present invention can also be incorporated into other types of musical tone generators. FIG. 5 shows an alternate embodiment of the invention incorporated into a musical tone generator of the type described in U.S. Pat. No. 3,515,792 entitled "Digital Organ." This patent is hereby incorporated by reference.

The system blocks shown in FIG. 5 having numbers in the 300 series correspond to the same elements shown in FIG. 1 of the referenced U.S. Pat. No. 3,515,792 having the same two last digits.

The waveshape memory 324 is a read-only addressable memory which stores 64 equally spaced points for a waveshape having a maximum of 32 harmonics. The even waveshape memory 151 contains waveshape data points having even symmetry which is the same as that already described for the same labeled block elements in FIG. 4. The odd waveshape memory 152 contains waveshape data points having odd symmetry which is the same as that already described for the same labeled block element in FIG. 4.

The remainder of the system shown in FIG. 5 operates in the manner already described for the system shown in FIG. 4.

I claim:

1. In combination with a musical instrument in which a plurality of sets of data words, wherein each set of data words corresponds to the amplitudes of points defining the waveform of a musical tone, are computed from preselected sets of harmonic coefficients and are transferred sequentially to a plurality of means for producing musical waveshapes, apparatus for producing a musical tone having an extended number of harmonics comprising;

a first waveshape memory means, a second waveshape memory means, a third waveshape memory means, a first harmonic coefficient memory means for storing a first set of harmonic coefficients at addressable memory locations, a second harmonic efficient memory means for storing at addressable memory locations a second set of harmonic coefficients corresponding to said extended number of harmonics, a harmonic addressing means for reading out elements of said first set of harmonic coefficients from said first harmonic coefficient memory means and for reading out elements of said second set of harmonic coefficients from said second harmonic coefficient memory means, a first means for computing responsive to said elements of said first set of harmonic coefficients read out from said first harmonic coefficient memory means whereby a first master data set of waveshape data points, corresponding to a first set of said plurality of sets of data words, are generated and stored in said first waveshape memory means, a second means for computing responsive to said elements of said second sets of harmonic coefficients read out from said second harmonic coefficient memory means whereby a second master data set of waveshape data points, corresponding to a second set of said plurality of data words, are generated and stored in said second waveshape memory means, a third means for computing responsive to said elements of said second set of harmonic coefficients read out from said second harmonic coefficient memory means whereby a third master data set of waveshape data points, corresponding to a third set of said plurality of sets of data words, are generated and stored in said third waveshape memory means and wherein said third master data set is orthogonal to said second master data set, a first means for producing a first musical tone at a preselected first fundamental frequency responsive to said first master set of data points stored in said first waveshape memory means, a second means for producing a second musical tone at a second fundamental frequency which is equal to one plus the number of elements in said first set of harmonic coefficients multiplied by said preselected first fundamental frequency wherein said second musical tone is produced by a side band modulation responsive to said second master data set of waveshape data points wherein said second master data set of waveshape points corresponds to a modulating signal and to said third master data set of waveshape data points wherein said third master data set of waveshape points correspond to a carrier signal, and a combining means responsive to said first musical tone and to said second musical tone whereby said musical tone having an extended number of harmonics is produced.

2. Apparatus according to claim 1 wherein said first means for computing comprises;

a clock for providing timing signals, a word counter for counting said timing signals modulo the number of data points comprising said first master data set of waveshape data points, a harmonic counter incremented each time said word counter returns to its minimal count state, and an adder-accumulator means wherein the count state of said harmonic counter is successively added to the contents of an accumulator in response to said timing signals.

3. Apparatus according to claim 2 wherein said harmonic addressing means comprises;

a harmonic address decoder responsive to the count state of said harmonic counter whereby elements of said first set of harmonic coefficients are read out from said first harmonic coefficient memory means and whereby elements of said second set of harmonic coefficients are read out from said second harmonic coefficient memory means.

4. Apparatus according to claim 2 wherein said first means for computing further comprises;

a first sinusoid table for storing a first plurality of trigonometric sinusoid function values, an address decoder means responsive to the count state of said accumulator in said adder-accumulator means whereby an address signal is generated, a sinusoid addressing means for reading out a trigonometric sinusoid function value from said first sinusoid table in response to said address signal, and a first master data set computing means responsive to said trigonometric sinusoid value read out from said first sinusoid table and elements of said first set of harmonic coefficients read out from said first harmonic coefficient memory means whereby said first master data set of waveshape points are generated and stored in said first waveshape memory means.

5. Apparatus according to claim 4 wherein said second means for computing comprises;

a second master data set computing means responsive to said trigonometric sinusoid function value read out from said first sinusoid table and elements of said second set of harmonic coefficients read out from said second harmonic coefficient memory means whereby said second master data set of waveshape points are generated and stored in said second waveshape memory means.

6. Apparatus according to claim 4 wherein said third means for computing comprises;

a second sinusoid table for storing a second plurality of trigonometric sinusoid function values wherein said second plurality of trigonometric sinusoid values are orthogonal to said first plurality of trigonometric sinusoid function values, a second sinusoid addressing means for reading out trigonometric sinusoid function values from said second sinusoid table in response to said address signal, and a third master data set computing means resonsive to said trigonometric sinusoid function values read out from said second sinusoid table whereby said third master data set of waveshape points are generated and stored in said third waveshape memory means and whereby said third master data set of waveshape data points is orthogonal to said second master data set of waveshape data points.

7. Apparatus according to claim 1 wherein said first means for producing a first musical tone comprises;

a fourth waveshape memory means, a data transfer means whereby said first master data set of waveshape points is transferred to said fourth waveshape memory means, a first reading means for successively and repetitively reading out said first master set of waveshape data values from said fourth waveshape memory means at a memory advance rate corresponding to said preselected first fundamental frequency, and a first conversion means for producing said first musical tone in response to said first master set of waveshape data set values read out from said fourth waveshape memory means.

8. Apparatus according to claim 1 wherein said second means for producing a musical tone comprises;

a single side-band modulator responsive to said second master data set of waveshape points stored in said second waveshape memory and responsive to said third master data set of waveshape points stored in said second waveshape memory whereby said second musical tone is produced having a fundamental frequency equal to said second fundamental frequency.

9. Apparatus according to claim 8 wherein said single side-band modulator comprises;

an even waveshape memory means, an odd waveshape memory means, a data transfer means whereby said second master data set of waveshape points is transferred to said odd waveshape memory means and whereby said third master data set of waveshape points is tranferred to said even waveshape memory means, a first reading means for simultaneously successively and repetitively reading out in phase said second master data set of waveshape points from said even waveshape memory means and said third master data set of waveshape points from said odd waveshape memory means at a memory advance rate corresponding to said preselected first fundamental frequency, a first trigonometric sinusoid table memory storing values of the trigonometric sine function, a second trigonometric sinusoid table memory storing values of the trigonometric cosine function, a second reading means for simultaneously successively and repetitively reading out in phase sine function values from said first trigonometric sinusoid table and cosine function values from said second trigonometric sinusoid table at a memory advance rate corresponding to said preselected first fundamental frequency multiplied by the number of elements in said first set of harmonic coefficients, a first modulator means comprising a multiplier for multiplying said second master data set of waveshape points read out from said odd waveshape memory means by said cosine function values read out of said second trigonometric sinusoid table to form a sequence of points comprising a first modulated signal, a second modulator means comprising a multiplier for multiplying said third master data set of waveshape points read out from said even waveshape memory means by said sine function values read out of said first trigonometric sinusoid to form a sequence of points comprising a second modulated signal, and a subtract means for pointwise subtracting elements of said second modulated signals from corresponding elements of said first modulated signals thereby producing said second musical tone.

10. In combination with a musical instrument in which a plurality of data words corresponding to the amplitudes of points defining the waveform of a musical tone are computed from a preselected set of harmonics coefficients and are transferred sequentially to a means for producing musical waveshapes, apparatus for producing a musical tone having an extended number of harmonics comprising;

a first waveshape memory means for storing a first set of data points defining a waveform of a first augmented musical tone, a second waveshape memory means for storing a second set of data points defining the waveform of a second augmented musical tone which is orthogonal to said first augmented musical tone, a third waveshape memory means, a harmonic coefficient memory means for storing a set of harmonic coefficients at addressable memory locations, a harmonic addressing means for reading out elements of said set of harmonic coefficients from said harmonic coefficient memory means, a means for computing responsive to elements of said set of harmonic coefficients read out from said harmonic coefficient memory means whereby a master data set comprising said plurality of data words is generated and stored in said third waveshape memory means, a first means for producing a first musical tone at a preselected first fundamental frequency responsive to said plurality of data words stored in said third waveshape memory means, a second means for producing a second musical tone at a second fundamental frequency which is equal to one more than the number of elements in said set of harmonic coefficients multiplied by said first fundamental freqency wherein said second musical tone is produced by a side-band modulation responsive to said first set of data points stored in said first waveshape memory means and to said second set of data points stored in said second waveshape memory means wherein said first set of data points corresponds to a modulation signal and said second set of data points corresponds to a carrier signal, and a combining means responsive to said first musical tone and to said second musical tone whereby said musical tone having an extended number of harmonics is produced.

11. Apparatus according to claim 10 wherein said means for producing a first musical tone comprises;

a fourth waveshape memory means, a data transfer means whereby said master data set of waveshape data points is transferred to said fourth waveshape memory means, a first reading means for successively and repetitively reading out said master data set of waveshape data points from said fourth waveshape memory means at a memory advance rate corresponding to said preselected first fundamental frequency, and a first conversion means for producing said first musical tone in response to said master data set of waveshape data points read out from said fourth waveshape memory means.

12. Apparatus according to claim 10 wherein said second means for producing a second musical tone comprises;

a single side-band modulator responsive to said first set of data points stored in said first waveshape memory means and responsive to said second set of data points stored in said second waveshape memory means whereby said second musical tone is produced having a fundamental frequency equal to said second fundamental frequency.

13. Apparatus according to claim 12 wherein said single side-band modulator comprises;

a first reading means for simultaneously successively and repetitively reading out in phase said first set of data points from said first waveshape memory means and said second set of data points from said second waveshape memory means at a memory advance rate corresponding to said preselected first fundamental frequency, a first trigonometric sinusoid table storing values of the trigonometric sine function, a second trigonometric sinusoid table storing values of the trigonometric cosine function, a second reading means for simultaneously successively and repetitively reading out in phase sine function values from said first trigonometric sinusoid table and cosine function values from said second trigonometric sinusoid table at a memory advance rate corresponding to said second fundamental frequency, a first modulator means comprising a multiplier for multiplying said first set of data points read out from said first waveshape memory means by said cosine function values read out from said second trigonometric sinuoid table to form a sequence of points comprising a first modulated augmented signal, a second modulator means comprising a multiplier for multiplying said second set of data points read out from said second waveshape memory means by said sine function values read out from said first trigonometric sinusoid table to form a sequence of points comprising a second modulated augmented signal, and a subtract means for pointwise subtracting elements of said second modulated augmented signal from corresponding elements of said first modulated augmented signal thereby producing said second musical tone.

14. In combination with a musical instrument in which a plurality of sets of points wherein each set of data points defines a waveform of a musical tone are stored in a a like plurality of waveshape memories and are transferred sequentially from each such waveshape memory to a means for producing musical waveshapes, apparatus for producing a musical tone having an extended number of harmonics comprising;

a first waveshape memory means for storing a first set of data points defining a waveform of a first augmented musical tone, a second waveshape memory means for storing a second set of data points defining a waveform of a second augmented musical tone, a third waveshape memory means for storing a third set of data points defining a waveform of a third musical tone, a first means for producing a first musical tone at a preselected first fundamental frequency responsive to said third set of data points stored in said third waveshape memory means, a second means for producing a second musical tone at a second fundamental frequency which is higher than said first fundamental frequency wherein said second musical tone is produced by a side-band modulation response to said first set of data points stored in said first waveshape memory means and to said second set of data points stored in said second waveshape memory means wherein said first set of data points corresponds to a modulation signal and said second set of data points corresponds to a carrier signal, and a combining means responsive to said first musical tone and to said second musical tone whereby said musical tone having an extended number of harmonics is produced.

15. Apparatus according to claim 14 wherein said first means for producing a musical tone comprises;

a first reading means for successively and repetitively reading out said third set of data points from third waveshape memory means at a memory advance rate corresponding to said preselected first fundamental frequency, and a first conversion means for producing said third musical tone in response to said third set of data points read out from said third waveshape memory means.

16. Apparatus according to claim 14 wherein said second means for producing a second musical tone comprises;

a single side-band modulator responsive to said first set of data points stored in said first waveshape memory means and responsive to said second set of data points stored in said second waveshape memory means whereby said second musical tone is produced having a fundamental frequency equal to said second fundamental frequency.

17. Apparatus according to claim 16 wherein said single side-band modulator comprises;

a first reading means for simultaneously successively and repetitively reading out in phase said first set of data points from said first waveshape memory means and said second set of data points from said second waveshape memory means at a memory advance rate corresponding to said preselected first fundamental frequency, a first trigonometric sinusoid table storing values of the trigonometric sine function, a second trigonometric sinusoid table storing values of the trigonometric cosine function, a second reading means for simultaneously successively and repetitively reading out in phase sine function values from said first trigonometric sinusoid table and cosine function values from said second trigonometric sinusoid table at a memory advance rate corresponding to said second fundamental frequency, a first modulator means comprising a multiplier for multiplying said first set of data points read out from said first waveshape memory means by said cosine function values read out from said second trigonometric sinusoid table to form a sequence of points comprising a first modulated augmented signal, a second modulator means comprising a multiplier for multiplying said second set of data points read out from said second waveshape memory means by said sine function values read out from said first trigonometric sinusoid table to form a sequence of points comprising a second modulated augmented signal, and a subtract means for pointwise subtracting elements of said second modulated augmented signal from corresponding elements of said first modulated signal thereby producing said second muscial tone.

* * * * *